United States Patent [19]

Shimoya

[11] 4,305,066

[45] Dec. 8, 1981

[54] MOTOR DRIVEN BELL SOUND GENERATING SYSTEM

[75] Inventor: Shigeo Shimoya, Tokyo, Japan

[73] Assignee: Kobishi Electric Co., Ltd., Kita, Japan

[21] Appl. No.: 98,404

[22] Filed: Nov. 29, 1979

[30] Foreign Application Priority Data

Jul. 31, 1979 [JP] Japan ..... 54-105429[U]
Jul. 31, 1979 [JP] Japan ..... 54-105430[U]
Jul. 31, 1979 [JP] Japan ..... 54-105431[U]

[51] Int. Cl.[3] ..... G10K 1/065

[52] U.S. Cl. ..... 340/392; 340/399; 340/402

[58] Field of Search ..... 340/390, 392, 399, 396, 340/402; 84/103; 116/155

[56] References Cited

U.S. PATENT DOCUMENTS

| | | | |
|---|---|---|---|
| 2,104,963 | 1/1938 | Anderson | 340/392 |
| 2,972,139 | 2/1961 | Knutson | 340/392 |
| 3,580,217 | 5/1971 | Blosse | 340/392 |
| 3,769,870 | 11/1973 | Huber | 340/399 |

*Primary Examiner*—Harold I. Pitts

*Attorney, Agent, or Firm*—Kane, Dalsimer, Kane, Sullivan & Kurucz

[57] ABSTRACT

A motor driven bell sound generation system is constructed such that rotational movement of a motor is converted into reciprocative hammering operation or single directional striking operation of hammer means via a crank means, driving means with radial protrusions on the outer periphery thereof or lever mechanism, whereby the required quality and volume of bell sounding is produced. A resilient means comprising a coil spring-leaf spring combination or single coil spring may be arranged for conversion of the rotational movement of the motor into the hammering or striking operation of the hammer means between the motor and the hammer means. Rotational movement of the motor may be converted into a reciprocative striking operation of the hammer means via a combination of driving member having ratchet on the outer periphery and a leaf spring. Alternatively rotational movement of the motor may be converted into swinging operation of the hammering arm or into reciprocative striking operation of the hammering rod via a worm gear and worm wheel mechanism and lever member.

8 Claims, 20 Drawing Figures

MOTOR DRIVEN BELL SOUND GENERATING SYSTEM

BACKGROUND OF THE INVENTION

1. Field of the Invention

The present invention relates to a motor driven bell sound generating system in which a small motor is incorporated for energizing the system, and more particularly to a bell sound generating system constructed such that rotational movement of the motor is converted into reciprocative or turning operation of the hammer, hammer arm or hammering rod so that striking or hammering effect is imparted to the bell gong which serves as a sound source.

2. Description of the Prior Art

Electrically driven bells are widely known in the art including those having electromagnetically driven hammer means for generating a bell sound. To facilitate the understanding of the invention this kind of the conventional electromagnetically driven bell sound generating system will be briefly described with reference to FIG. 1 as follows.

As illustrated in FIG. 1, a bobbin 2 with a magnetic core 2*a* inserted therein and a stationary contact plate 3 are securely mounted on the yoke 1, while a vibratory plate 5 having a leaf spring 4 connected thereto at its bottom portion is rotatably supported by means of the vertically extending support members on the yoke. On the extreme end of said leaf spring 4 is formed a contact 4*a*, while on the top end of said stationary contact plate 3 is formed another contact 3*a*. Further a lead wire 6 is extended from the one end of the coil 2*b* on said bobbin 2, while another lead wire 7 is extended from the bottom portion of said stationary contact plate 3. Further on the top end of said vibratory plate 5 is arranged a hammer 8 secured thereto at the bottom portion thereof, said hammer 8 being extended through an opening on the yoke 1. A coil spring 9 is arranged about the hammer 8, one end of said coil spring 9 being connected to the yoke 1 in the vicinity of said opening. The bell gong 10 is located at the predetermined distance from the extreme end of the hammer 8.

As direct current is applied to the lead wires 6 and 7, it flows through the lead wire 6, the coil 2*b*, the contact 4 on the leaf spring 4 and the contact 3*a* on the stationary contact plate 3 to the lead wire 7. As the bobbin 2 is energized, attractive force is produced through the magnetic core 2*a*, whereby the vibratory plate 5 is drawn toward said magnetic core 2*a*. Thus the hammer 8 is displaced against the coil spring 9 so as to strike the inner wall of the bell gong 10. At the same time the contact 3*a* is parted away from the other contact 4*a*, causing the electrical current flow to turn off. The magnetic core 2*b* becomes demagnetized and thereby the vibratory plate 5 is restored to the original position by means of the resilient force of the coil spring 9. This causes the both contact 3*a* and 4*a* to come in contact each other again, resulting in the second electrical current flow produced so as to carry out hammering or striking operation against the bell gong to generate the required bell sound. Then the above described operations are repeated.

It is recognized as a drawback with the above described conventional bell sound generating system that it is difficult to select and determine the number of hammering or striking operations per unit time as required, because said number of hammering or striking operations against the bell gong 10 with the use of the hammer 8 is dependent on a variety of factors such as rigidity of the leaf spring 4, weight of the hammer, spring constant of the coil spring 9 and others. Further it is pointed out as another drawback that it is difficult to select and determine the working stroke of the hammer 8 as required, because the movable contact 3*a* is released from the stationary contact 4*a* within the very short period of time. Therefore, as far as the conventional bell sound generating system is concerned, it may be concluded that because of the above mentioned drawbacks therewith it is difficult to construct a bell sound generating system on a commercial basis, which has the optimum number of hammering or striking operations and as well as the optimum working stroke of hammer means, in spite of the fact that the number of hammering operations and working strokes at which the maximum bell sounding is produced are available only on the experimental basis.

SUMMARY OF THE INVENTION

The present invention is intended to eliminate the drawbacks with the conventional electromagnetically driven bell sound generating system and is characterized in that a small motor is incorporated into the system as a driving source and rotational movement of said motor is converted into reciprocative or swinging operation of hammer means so as to generate the required quality and volume of bell sounding by hammering or striking operation of the hammer means against the bell gong.

Hence it is an object of the invention to provide a new and unique motor driven bell sound generating system which is capable of generating any required quantity and volume of bell sounding.

It is other object of the invention to provide a motor driven bell sound generating system which is capable of easily selecting and determining the optimum number of hammering or striking operations and working strokes of hammer means.

It is another object of the invention to provide a motor driven bell sound generating system which is simple in structure and easy to be manufactured.

Other objects and advantageous features of the invention will be apparent from the following description.

BRIEF DESCRIPTION OF THE ACCOMPANYING DRAWINGS

Now the present invention will be described in further detail with reference to the accompanying drawings which illustrate the typical arrangement of the conventional system and the preferred embodiments of the invention, in which.

DETAILED DESCRIPTION OF THE PREFERRED EMBODIMENTS OF THE INVENTION

Figure 1:
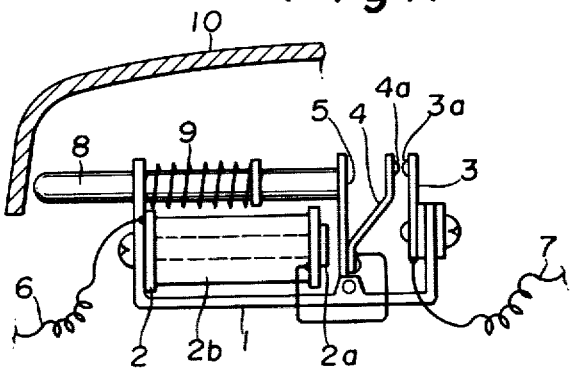
FIG. 1 is a schematic illustration of the arrangement of the conventional electromagnetically driven bell sound generating system, wherein a part of the bell gong is partially shown in a sectional view.

First, the motor driven bell sound generating system in accordance with the first embodiment of the invention will be described with reference to FIGS. 2 to 6.

In the drawings the reference numeral 11 denotes a motor, of which rotating shaft 12 is provided with a circular disc 13 having an integral crank member 14 located in an eccentric position therefrom. Said motor 11 is securely fastened to the mounting plate 16 which is formed by bending up a cut portion of the base board 15. In the meantime, a leaf spring 18 is securely fastened to another mounting plate 17 at its one end with the aid of eyelet or the like, said mounting plate 17 being formed by being up a cut portion of the base board 17, whereas the other end of said leaf spring 17 is kept free. If the vicinity of said free end of the leaf spring 18 is located a hammer 20 which serves to strike against the inner wall of the bell gong (not shown). As shown in the drawings, a coil spring 21 is spanned between the crank member 14 on the circular disc 13 and the free end of the leaf spring 18 so that interconnection is made therebetween.

Figure 2:
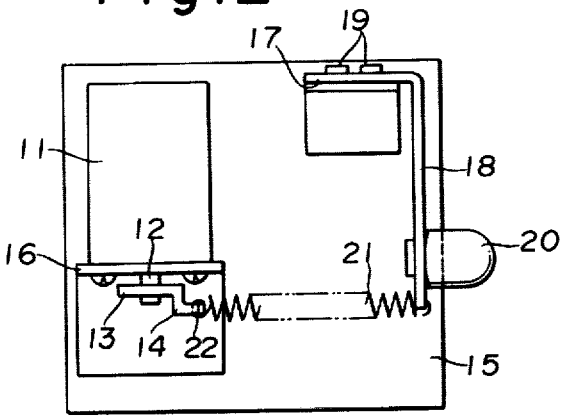
FIG. 2 is a plan view of a motor driven bell sound generating system in accordance with the first embodiment of the invention, wherein the bell gong is removed for the purpose of simplification of illustration.
Figure 3:
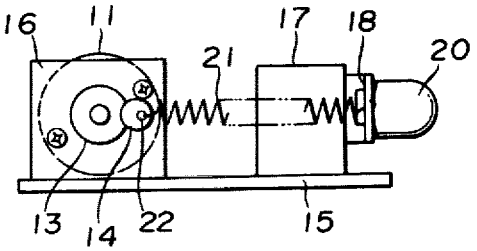
FIG. 3 is a front view of the motor driven bell sound generating system in FIG. 2.
Figure 4:
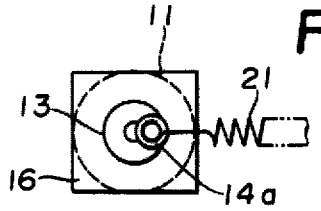
FIG. 4 is a partial front view of the modified crank member in use for the bell sound generating system in accordance with the first embodiment of the invention.
Figure 5:
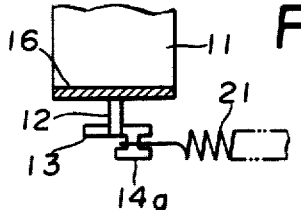
FIG. 5 is a partial plan view of the modified crank member as illustrated in FIG. 4.

In the embodiment in FIGS. 2 and 3 the crank member 14 is formed with an aperture 22 into which the one end of the coil spring 21 is extended, resulting in an engagment of the crank member 14 to the coil spring 21 provided. As illustrated in FIGS. 4 and 5, the integral crank member 14 may be formed in a shape of grooved drum, around which one end of the coil spring 21 is hung for an engagment therebetween, whereby it is ensured that rotational movement of the crank member 14 is smoothly converted into reciprocative movement of the coil spring 21.

Figure 6:
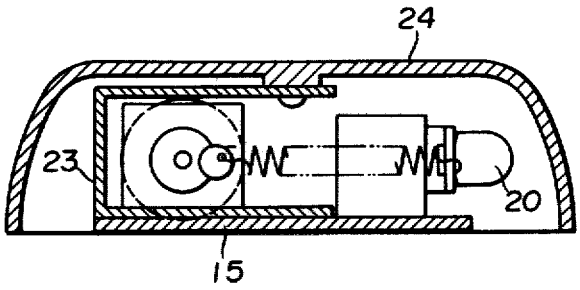
FIG. 6 is a vertical sectional view of the bell sound generating system in accordance with the first embodiment of the invention, said system being secured to the bell gong.

The mounting of the bell sound generating system in accordance with the first embodiment of the invention is effected in such a manner as illustrated in FIG. 6. Namely, the base board 15 is fixed to the mounting frame 23 which is in turn secured to the bell gong 24 at the central part thereof so that the hammer 20 is located in place against the inner wall of the bell gong 24 so as to impart the optimum striking motion thereto.

Now operation of the motor driven bell sound generating system in accordance with the first embodiment of the embodiment will be described below.

As the motor 11 is switched on, the rotating shaft 12 is rotated. Then the crank member 14 on the circular disc 13 turns about the rotation shaft 12, whereby the coil spring 21 is subjected to reciprocative movement. Since the other end of the coil spring 21 is engaged to the free end of the leaf spring 18, said reciprocative movement of the coil spring 21 is transferred to the leaf spring 18 in the form of vibrative movement, which causes the hammer 20 to be displaced against the inner wall of the bell gong 24. Thus the required bell sound is generated.

In this connection it is to be noted that said coil spring 21 and leaf spring 18 are effective in absorbing hammering impact to some extent, which is caused as the hammer 20 strikes against the bell gong 24 as well as in maintaining the aforesaid hammering effect for the predetermined period of time to ensure the enlarged volume of bell sound. Further it is recognized that this advantageous effect is little brought merely by means of the leaf spring 18 and that the same is amplified by way of cooperation of the leaf spring 18 with the coil spring 21. Additionally, owing to the fact that the resilient force of the coil spring 21 and the leaf spring 18 is added to the hammering movement of the hammer 20 toward the bell gong 24, it is ensured that the working stroke of the hammer 20 is substantially increased.

Figure 7:
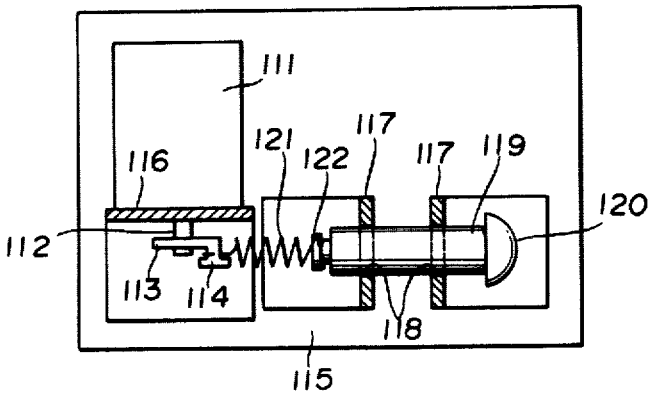
FIG. 7 is a schematic plan view of the motor driven bell sound generating system in accordance with the second embodiment of the invention, wherein the bell gong is removed.
Figure 8:
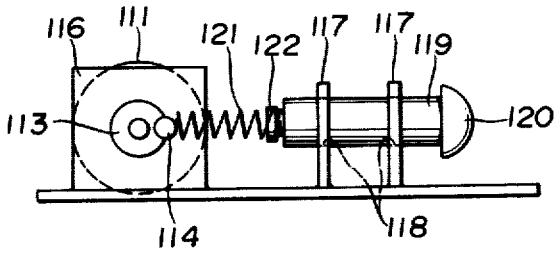
FIG. 8 is a front view of the bell sound generating system in FIG. 7.

Next, the motor driven bell sound generating system in accordance with the second embodiment of the invention will be described with reference to FIG. 7 to 9.

In the drawings the reference numeral 111 denotes a motor, of which rotating shaft 112 is provided with a circular disc 113 having an integral crank member 114 located in an eccentric position therefrom. Said motor 111 is secured to the mounting plate 116 which is formed by bending up a cut portion of the base board 115. In the meantime, support members 117 which are formed by bending up a cut portion of the base board 115 in the same manner are provided with an opening 118 in the center thereof respectively, through which a hammer 119 is supported displaceably in the forward and backward directions. As apparent from the drawings, the head of the hammer 120 is so dimensioned that it has an outer diameter larger than the inner diameter of said opening 118 so that the hammer 120 does by no means escape out of the support member 117. A coil spring 121 is provided, which is connected to the crank member 114 at one end thereof and to the tail portion 122 of the hammer 119 at the other end thereof. The engagement of the crank member 114 to the coil spring 121 is such that the latter is loosely hung on the former, whereby the rotational movement of the crank member 114 is smoothly converted into the reciprocative movement of the coil spring 121.

Figure 9:
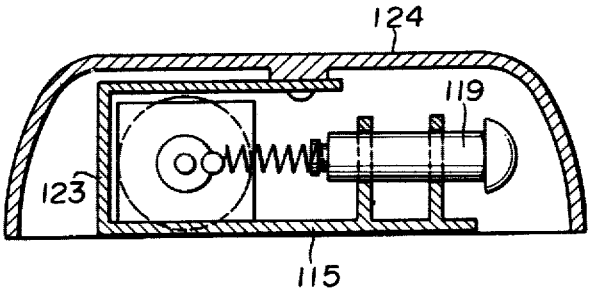
FIG. 9 is a vertical sectional view of the bell sound generating system in accordance with the second embodiment of the invention together with the bell gong to which said system is secured.
Figure 10:
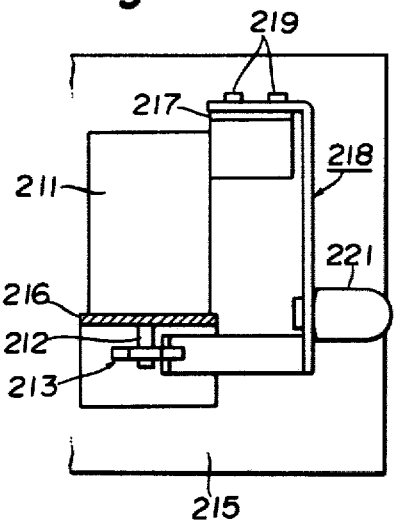
FIG. 10 is a schematic plan view of the motor driven bell sound generating system in accordance with the third embodiment of the invention, wherein the bell gong is removed in the same sense.

The mounting of the bell sound generation system in accordance with the second embodiment of the invention is effected in such a manner as illustrated in FIG. 9. Namely, the base board 115 is fixed to the mounting frame 123 which is in turn secured to the bell gong 124 at the central part thereof. Thus the hammer 120 is located in place against the inner side wall of the bell gong 124 so as to ensure the optimum striking motion by means of said hammer 120.

Now operation of the motor driven bell sound generating system in accordance with the second embodiment of the invention will be described below.

As the motor 111 is switched on, the rotating shaft 112 is rotated. Then the crank member 114 on the circular disc 113 turns about the rotating shaft 112, whereby the coil spring 121 is subjected to reciprocative movement. Since the other end of the coil spring 121 is connected to the tail portion of the hammer 119 which is extended through the openings 118 of the support members 117 and supported thereby displaceably in the forward and backward directions, the hammer is reciprocatively displaced toward or away from the bell gong 124 so that the required bell sound is generated.

In this connection it is to be noted that said coil spring 121 is effective in absorbing the hammering impact to some extent, which is caused as the hammer 119 strikes against the bell gong 124 as well as in maintaining the above described hammering effect for the predetermined period of time to ensure the enlarged volume of bell sound.

Further it is to be added that owing to the fact that the resilient force of the coil spring 121 is added to the hammering movement of the hammer 119 toward the bell gong 124, the working stroke of the hammer 119 can be substantially lengthened. To enable the aforesaid hammering effect and the working stroke of the hammer 119 to be adjusted as required, another coil spring may be arranged about the cylindrical body of the hammer 119 between the head portion 120 and one of the support members 117.

Next, the motor driven bell sound generating system in accordance with the third embodiment of the invention will be described with reference to FIG. 10 to 13.

Figure 12:
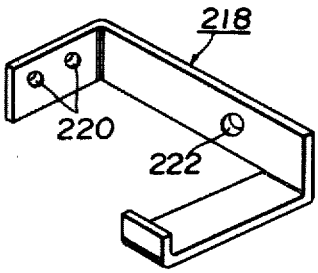
FIG. 12 is a perspective view of the formed leaf spring in use for the bell sound generating system as illustrated in FIG. 10 and 11.

In the drawings the reference numeral 211 denotes a motor, of which rotating shaft 212 is provided with a ratchet wheel 213 formed with a plurality of ratches 214 which extend from the center of rotation in the radial direction, so that the ratches 214 come in intermittent engagement with the bent portion of a leaf spring which will be described later. Particularly the same number of engagements as that of said radial ratches 214 (three in number in this illustrated embodiment) are effected during one rotation of the rotating shaft 212 to drive the leaf spring. The motor 211 is securely fastened to the mounting plate 216 which is formed by bending up a cut portion of the base board 215. Said leaf spring 218 is fixed at its one end to another mounting plate 217, which is formed in the same manner as said mounting plate 216 with the aid of an eyelet or the like, while the other end of the leaf spring 218 is kept free. This leaf spring 218 is as illustrated in FIG. 12. The leaf spring 218 is made by bending a strip of leaf spring material to the form as illustrated in the drawing and is formed with holes 220 through which eyelet 219 or the like extends and another hole 222 by means of which a hammer 221 is fixed thereto, whereas at the free end of said leaf spring 218 is provided an engagement portion 223 which is formed by bending the extreme end thereof in the upward direction. This engagement portion 223 is located so as to come in engagement with the ratches 214 of the ratchet wheel 213.

It should be understood that the aforesaid ratchet wheel 213 isn't be limited only to the structure as illustrated in the drawings and that the same may be replaced with another driving wheel or arrangement which is constructed, for instance, in such a manner that a main gear wheel is mounted on the rotation shaft 212 and a pinion is arranged in engagement with said main gear wheel, said pinion being formed with radially extending ratch means on the outer periphery thereof in the same way as the radial ratches 214 on the ratchet wheel 213. In this modified embodiment it is possible to adjust the number of bell striking operations per unit time by way of adjusting the ratio of rotation numbers of the main gear wheel and pinion, instead of the speed controller for the motor, which is intended to adjust the number of bell striking operations.

Figure 13:
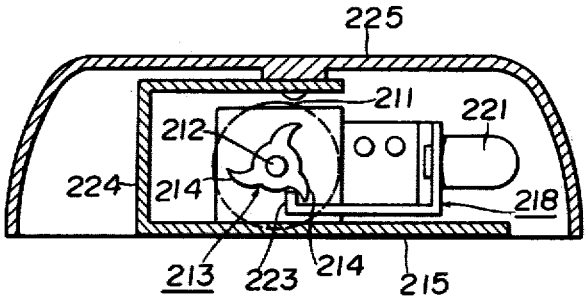
FIG. 13 is a vertical sectional view of the bell sound generating system in accordance with the third embodiment of the invention together with the bell gong to which said system is secured.

The mounting of the bell sound generating system in according with the third embodiment of the invention is effected in the same manner as the preceding embodiments. As illustrated in FIG. 13, the base board 215 is fixed to the mounting plate 224 which is in turn secured to the bell gong 225 at the central part thereof. Now the hammer 221 is ready to strike against the bell gong 225.

Operation of the motor driven bell sound generating system in accordance with the third embodiment of the invention will be described below.

Figure 11:
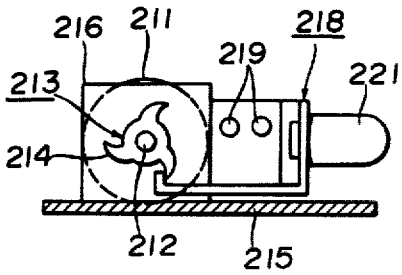
FIG. 11 is a front view of the bell sound generating system in FIG. 10.

As the motor 211 is switched on, the rotation shaft 212 is rotated together with the ratchet wheel 213 secured thereto. Then the radial ratchet 214 on the ratchet wheel 213 comes in engagement with the upward bent portion of the leaf spring 218, causing said leaf spring 218 to be displaced to the left as seen in FIG. 11 and 13. When the ratchet 213 is disengaged from the bent portion 223 as the motor is further rotated, the leaf spring 218 is repulsed to the right due to the resilient force thereof. As a result the hammer 221 secured to the end portion of the leaf spring 218 performs striking operation against the bell gong 225. After completion of striking operation the leaf spring 218 is restored to the original position so that it is ready for next operation. As the motor continues to be rotated, striking operations are repeated in the above described manner.

In this connection it is to be noted that said leaf spring 218 is effective in absorbing the hammering impact to some extent, which is caused as the hammer 221 strikes against the bell gong 225 as well as in maintaining the above described hammering effect for certain period of time to ensure the enlarged volume of bell sounding. Further it is to be added that the aforesaid leaf spring 218 makes it possible to lengthen the working stroke of the hammer 221.

Next, the motor driven bell sound generating system in accordance with the fourth embodiment of the invention will be described with reference to FIG. 14 to 16. As described above, the motor driven bell sound generating system in accordance with the respective preceding embodiments consists in that hammering operations are performed by way of reciprocative movement of the hammer means which is energized by a motor. To the contrary the motor driven bell sound generating system in accordance with the fourth embodiment of the invention consists in that bell sound is generated in such a manner that rotational movement of a motor is converted into turning movement of a hammer arm via a reduction gearing so that a hammer means on the outer end portion of the hammer arm strikes against the protruded portion of the bell gong.

In the drawing the reference numeral 311 denotes a motor, of which rotation shaft 312 is provided with a worm gear 313 secured thereto at the extreme end thereof. On a vertically extending shaft 315 is arranged a worm wheel 314 in engagement with said worm gear 313 and further on the top end of said shaft 315 is arranged an arm 316 which extends in the horizontal direction. Said arm 316 is preferably made of resilient wire material such as piano wire. The arm 316 is provided with a hammer 317 secured to the outer end thereof. As illustrated in FIG. 14, all components of the bell sound generating system are tightly mounted to the support plate 318 which is in turn is secured to the bell gong 320 with the aid of a bolt 319. On the inner wall of the bell gong 320 is formed a protrusion 321 which protrudes inwards in the radial direction, against which the top end of the hammer 317 is located to impart striking effect.

Now operation of the motor driven bell sound generating system in accordance with the fourth embodiment of the invention will be described below.

As the motor is switched on, the rotation shaft 312 is rotated together with the worm gear 313 secured thereto. The rotational movement of the worm gear 313 is transferred to the worm wheel 314, whereby the arm 316 secured to the worm wheel 314 turns, causing the hammer 317 on the extreme end of the arm 317 to strike against the protrusion 321 on the inner wall of the bell gong so as to generate the required bell sound. One rotation of the worm wheel produces one hammering activity.

It will be readily understood that by way of adjusting the gear reduction ratio of the worm gear 313 and worm wheel 314, the magnitude of striking effect by the hammer or the height of the protrusion 321 and the quality and volume of bell sounding can be easily controlled.

Figure 14:
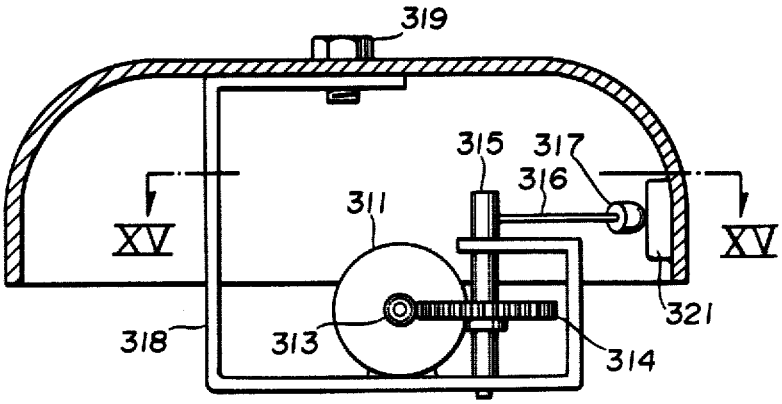
FIG. 14 is a schematic front view of the motor driven bell sound generating system in accordance with the fourth embodiment of the invention, wherein the bell gong with said system secured thereto is shown in a vertical sectional view.
Figure 15:
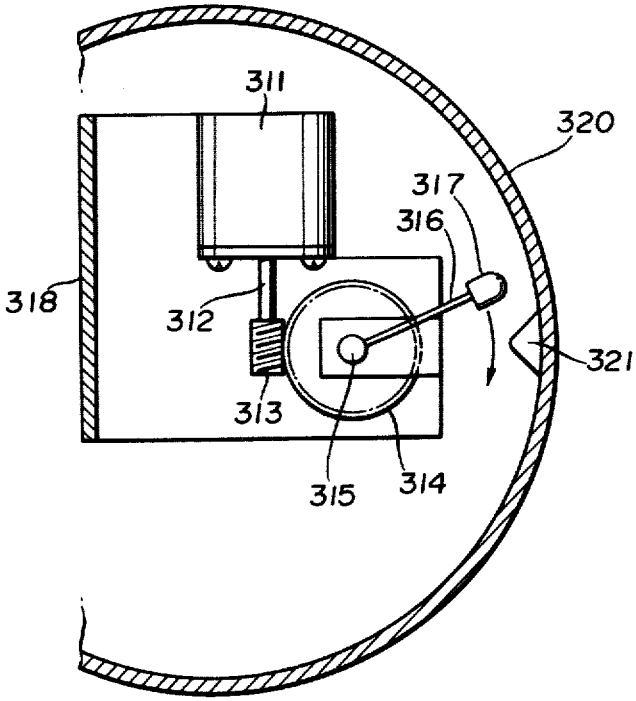
FIG. 15 is a plan view of the bell sound generating system, taken in line XV—XV in FIG. 14, wherein the bell sound is partially shown in a sectional view.
Figure 16:
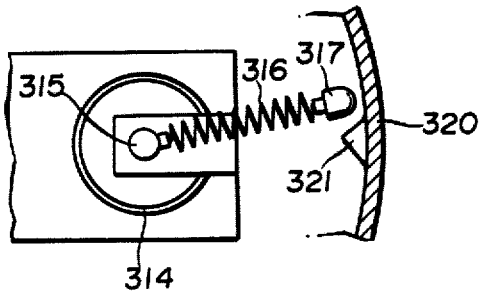
FIG. 16 is a partial schematic plan view of the modified hammer in use for the bell sound generating system in accordance with the fourth embodiment of the invention in FIG. 14 and 15.

In the embodiment as illustrated in FIG. 14 and 15, resilient wire material is used for the hammer arm 316. Alternatively the hammer arm 316 may be constructed of a coil spring instead of the solid wire material, as illustrated in FIG. 16. This may be preferable, because a coil spring has flexiblilty higher than that of a solid wire, resulting in less possibility of breakage of the hammer arm caused due to material fatigue as well as in pleasant bell sounding produced.

Figure 17:
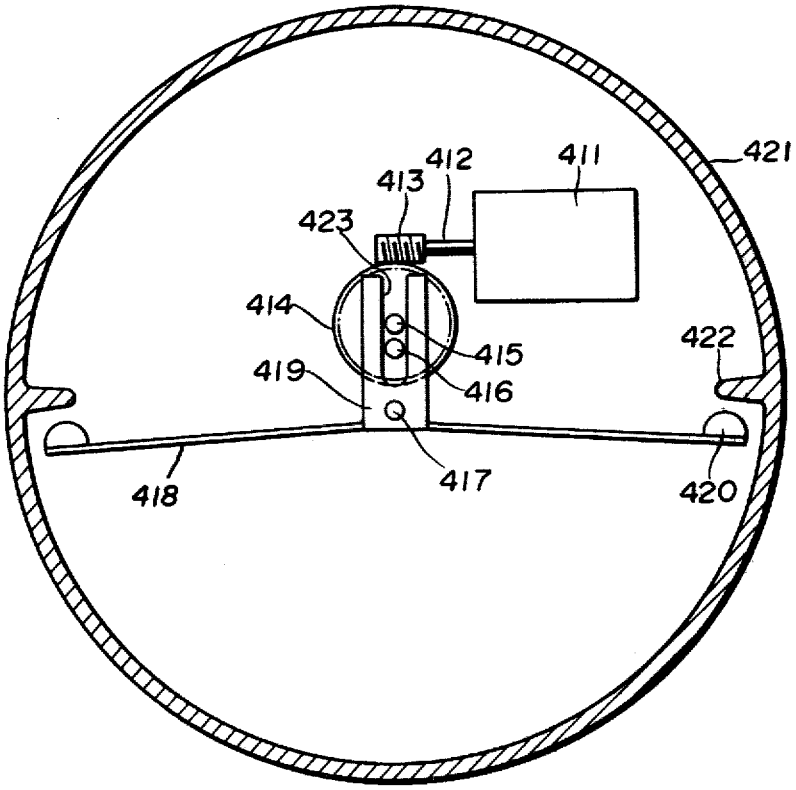
FIG. 17 is a schematic plan view of the motor driven bell sound generating system in accordance with the fifth embodiment of the invention, taken in line XVII—XVII in FIG. 18, wherein the bell gong is shown in a horizontal sectional view.
Figure 18:
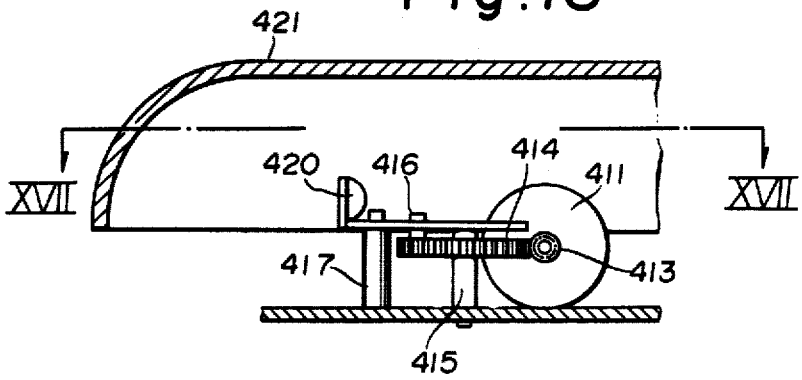
FIG. 18 is a front view of the bell sound generating system in FIG. 17, wherein the bell gong is partially shown in a vertical sectional view.

Next, the motor driven bell sound generating system in accordance with the fifth embodiment of the invention will be described with reference to FIG. 17 and 18.

In the drawings the reference numeral 411 denotes a motor, of which rotation shaft 412 is provided with a worm gear 413 secured thereto at the extreme end thereof. On the vertically extending shaft 415 is arranged a worm wheel 414 in engagement with said worm gear 413. Said worm wheel 414 is provided with a driving pin 416 on the upper surface thereof, said driving pin 416 being located in eccentricity from the rotation shaft 415 of the worm wheel 414. As apparent from the drawings, the driving pin 416 is in engagement with the hook portion 419 of a swing arm 417 within the slit 423 extending through said hook portion 419, said swing arm 417 being supported in a swinging manner about the vertical shaft 417 located substantially in the center of the bell gong 421. On the both ends of the arm member 418 in the form of twin arm are provided hammers 420 secured thereto, while on the inner wall of the bell gong 421 are provided protrusions 422 which extend inwards in the radial direction, said protrusions 422 being located at the predetermined distance from the hammers 420.

Now operation of the motor driven bell sound generating system in accordance with the fifth embodiment of the invention will be described below.

As the motor 411 is switched on, the rotation shaft 412 is rotated together with the worm gear 413 secured to the end portion thereof. The rotational movement of the worm gear 413 is transferred to the worm wheel 414, causing the same to be rotated. Thus the driving pin 416 on the worm wheel 414 is displaced along the circular track, of which radius is equal to the eccentricity from the rotation shaft 415. As the driving pin 416 performs circular movement, the arm member 418 is subjected to swinging movement about the support shaft 417 via the hook portion 419, whereby the hammers 420 on the both ends of the arm member 418 strike against the protrusions 422 of the bell gong 421. Thus the required bell sound is produced.

It will be readily understood that by way of adjusting the gear reduction ratio of the worm gear and worm wheel as well as the eccentricity of the driving pin the quality and volume of bell sounding can be easily controlled.

Figure 19:
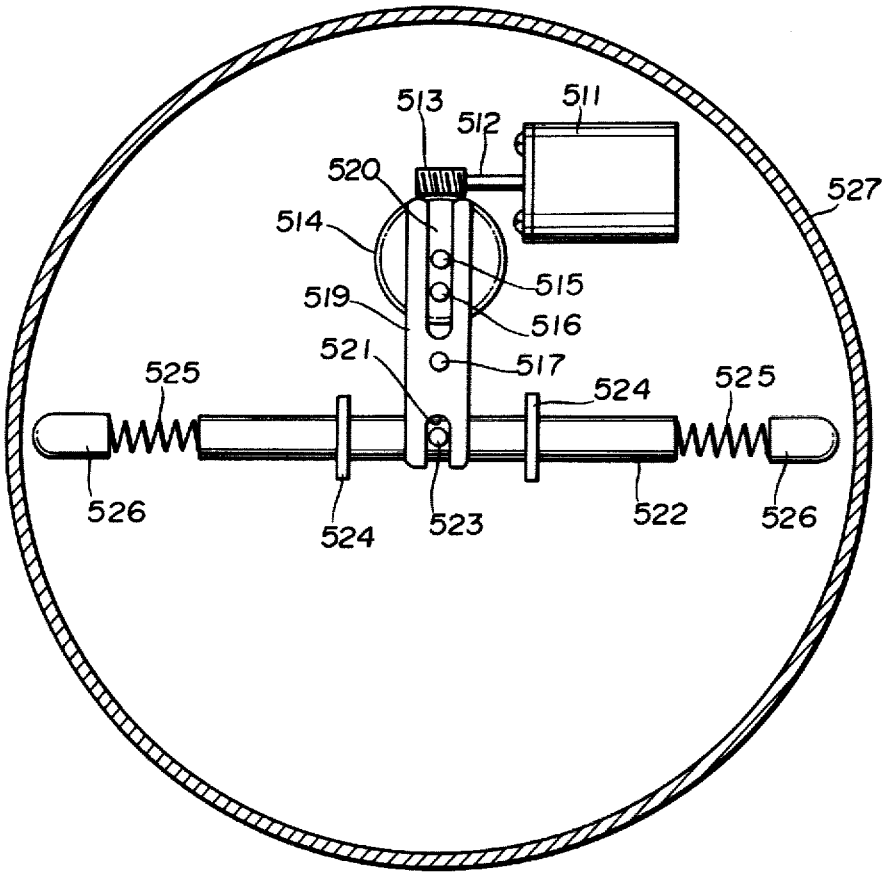
FIG. 19 is a schematic plan view of the motor driven bell sound generating system in accordance with the sixth embodiment of the invention, wherein the bell gong to which said system is secured is shown in a horizontal sectional view.
Figure 20:
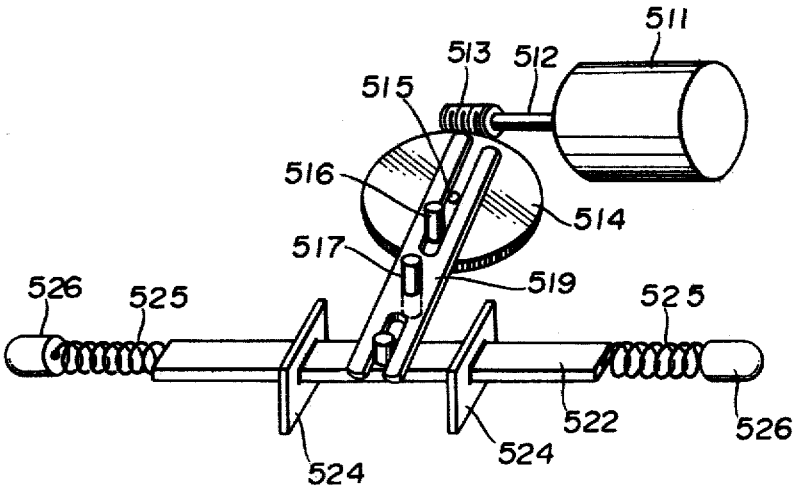
FIG. 20 is a perspective view of the bell sound generating system in FIG. 19, wherein the bell gong is removed for the purpose of simplification of illustration.

Finally, the motor driven bell sound generating system in accordance with the sixth embodiment of the invention will be described with reference to FIG. 19 and 20.

In the drawings the reference numeral 511 denotes a motor, of which rotation shaft 512 is provided with a worm gear 513 secured thereto at the extreme end portion thereof. On the vertically extending shaft 515 disposed on the base board (not shown) is rotatably arranged a worm wheel 514 in engagement with said worm gear 513.

The upper surface of the worm wheel 514 is provided with a vertically extending engagement pin 516 located in eccentricity from the rotation shaft thereof, said engaging pin coming in engagement with the lever member 519 within the longer slit 520 thereof, which is adapted to swing about the support shaft 517 vertically disposed in the vicinity of the bell gong 527. The opposite side of said longer slit 520 is provided with a vertically extending driving pin 523 which comes in engagement with the lever member 519 within the shorter slit 521 thereof, said driving pin 523 being fixed to the hammering rod 522 exactly at the center thereof.

The hammering rod 522 is reciprocatively displaceable in the both directions, being supported by the support plates 524 on the base board (not shown). On the both ends of the hammering rod 522 are arranged hammers 526 secured thereto via coil springs 525. The length of the hammer 526 is dimensioned so that the hammer 526 is located at the optimum distance from the inner wall of the bell gong 526.

Now operation of the motor driven bell sound generating system in accordance with the sixth embodiment of the invention will be described below.

As the motor 511 is switched on, the rotations shaft 512 is rotated together with the worm gear 513 secured thereto at the extreme end thereof. The rotation of the worm gear 513 is transferred to the worm wheel 514, causing said worm wheel 514 to be rotated, whereby the engagement pin 516 performs circular movement along the predetermined track having a radius equal to the eccentricity thereof from the support shaft 515. As the engagement pin 516 turns, the lever member 519 swings about the support shaft 517, whereby the driving pin 523 is reciprocatively displaced, which comes in engagement within the shorter slit 521 of said lever member 519. Thus the hammering rod 522 is operated by means of the driving pin 523 so that the hammers 526 strike against the inner wall of the bell gong 527. As a result the required bell sound is generated.

It will be readily understood that by adjusting the gear reduction ratio of the worm gear and worm wheel as well as the eccentricity of the both pins the quality and volume of bell sounding can be controlled in the same manner as the preceding embodiments.

As described above, the motor driven bell sound generating system in accordance with the present invention has an advantageous feature that it is simple in structure and adjustable in generating the required bell sound. Moreover it has the following additional features.

(a) It is possible to adjust the number of hammering operations per unit time caused by striking activities of the hammer, as required, by way of adjusting the number of rotations of the motor, the gear reduction ratio of the motor or the eccentricity of the driving pin and/or engagement pin so that the number of hammering operations is ensured for the maximum volume of bell sounding.

(b) It is possible to ensure the optimum period of time during which the hammer is striking against the bell gong by way of selectively determining the spring constant of the coil spring and/or leaf spring.

(c) It is possible to lengthen the working stroke of hammering operation by way of arranging a leaf spring and/or coil spring. Moreover it is possible to substantially lengthen the working life of the bell sound generating system owing to the fact that the excessive hammering force imparted against the bell gong by the hammer can be absorbed by the damping function of the spring means.

(d) It is possible to operate the bell sound generating system in less electrical power sumption than the conventional electromagnetic driven bell sound generating system.

The motor driven bell sound generating system has been described with respect to the six preferred embodiments of the present invention, as described above. It should be of course understood that the present invention isn't limited only to these preferred embodiments but it may be modified or changed without any departure from the spirit of the invention.

What is claimed is:

1. A motor driven bell sound generating system comprising a motor, a worm gear secured to a rotation shaft of said motor, a worm wheel in engagement with said worm gear, said worm wheel being provided with a driving pin securely disposed at a predetermined radial distance from a rotation shaft of the worm wheel, an arm member in the form of twin arm having hammer means integrally provided at the both ends thereof, arranged rotatably about a rotation axle located substantially at the center of a bell gong, said arm member being integrally provided with a hook member extending at a right angle thereto, which is formed with an elongated slit within which said driving pin is located for engagement therewith.

2. A motor driven bell sound generating system comprising a motor, a worm gear secured to a rotation shaft of said motor, a worm wheel in engagement with said worm wheel, said worm wheel being provided with an engagement pin securely disposed at a predetermined radial distance from a rotation shaft of the worm wheel, a lever means having outwardly extending elongated slits of different lengths at the both sides thereof, arranged rotatably about a rotation axle located substantially at the center of a bell gong, said engagement pin coming in engagement with said lever means within the longer one of said elongated slits, a hammering rod reciprocatively supported by means of support members, extending substantially across the center of the bell gong at a right angle to said lever means, said hammering rod being provided with a driving pin securely disposed at the middle thereof, said driving pin coming in engagement with said lever means within the shorter one of said elongated slits, and hammer means connected to said hammering rod at the both ends thereof via a coil spring.

3. A motor driven bell sound generating system comprising a base; a gong mounted on said base; a hammer mounted on said base for striking against said gong; a motor mounted on said base and having a rotatable drive shaft; a crank means fixedly mounted on said drive shaft for rotation therewith and having an eccentric portion offset from the axis of said drive shaft; and an elongated resilient means extending between said hammer and said eccentric portion, said resilient means being axially contractible and extending generally perpendicular to said drive shaft.

4. A motor driven bell sound generating system according to claim 3, in which said resilient means comprises a coil spring.

5. A motor driven bell sound generating system according to claim 4, further including a leaf spring secured at one end to said base and carrying said hammer at its free end, said leaf spring extending generally perpendicular to said coil spring, and said coil spring extending between said eccentric portion and the free end of said leaf spring.

6. A motor driven bell sound generating system comprising a base; a gong mounted on said base; a motor mounted on said base and having a rotatable drive shaft; a drive wheel fixedly mounted on said drive shaft for rotation therewith and having at least one radial engaging portion; a leaf spring of an L-shape defined by a pair of first and second legs, said first leg being secured to said base at one end remote from said second leg, and said second leg extending generally perpendicular to said drive shaft and having a second engaging portion at one end remote from said first leg; and a hammer secured to the other end of said first leg adjacent to said second leg for striking against said gong; said radial engaging portion being engageable with said second engaging portion to urge said hammer away from said gong.

7. A motor driven bell sound generating system comprising a base; a gong mounted on said base and having a protrusion; a motor mounted on said base and having a rotatable drive shaft; a worm gear fixedly mounted on said drive shaft; a support shaft rotatably mounted on and extending perpendicular to said base; a worm wheel fixedly mounted on said support shaft and meshingly engaged with said worm gear for rotation in a plane parallel to said base; and a hammer means having a hammer arm extending perpendicularly from said support shaft and a hammer element secured to the free end of said hammer arm for striking against said gong protrusion.

8. A motor driven bell sound generating system according to claim 7, in which said hammer arm is resilient.

* * * * *